US005188207A

United States Patent [19]

Hoffman

[11] Patent Number: 5,188,207

[45] Date of Patent: Feb. 23, 1993

[54] VENDING MACHINE COIN MECHANISM

[76] Inventor: Arlan J. Hoffman, 5137 Coldbrook Dr., Mantua, Ohio 44255

[21] Appl. No.: 811,718

[22] Filed: Dec. 20, 1991

[51] Int. Cl.[5] ..... G07F 5/04; G07F 11/36

[52] U.S. Cl. ..... 194/236; 194/255

[58] Field of Search ..... 194/234, 235, 236, 237, 194/238, 253, 254, 255, 291, 292

[56] References Cited

U.S. PATENT DOCUMENTS 2,748,915 6/1956 Byrnes ..... 194/234

5,070,986 12/1991 Hoffman et al. ..... 194/237

*Primary Examiner*—F. J. Bartuska

*Attorney, Agent, or Firm*—D. Peter Hochberg; Mark Kusner; Louis J. Weisz

[57] ABSTRACT

A coin mechanism for a vending machine comprises a cylinder rotatable in a passageway within a housing to release vended product to a purchaser. Operation of the mechanism requires insertion of purchase coins into coin slots accessible when the cylinder partially protrudes from the housing. The cylinder is thereafter substantially completely inserted into the housing and rotated by means of a handle located on one end thereof. Upon rotation of the cylinder, the coins prevent engagement of locking pawls mounted in the housing with either of two separate mechanism-blocking shoulders located on the cylinder. The end of the cylinder opposite the handle is connected to a coupler member, which in turn is fastened to a spiral product coil, rotation of the cylinder causing rotation of the coil and the release of product therefrom. The coupler member also includes a ratchet wheel which cooperates with a pawl in the housing to prevent improper rotation of the cylinder. Changes in the number and kind of coins required to operate the mechanism can be effected by adjusting the degree of cylinder travel into the housing, and by the insertion of coin-altering plugs inserted in the cylinder's coin slots.

17 Claims, 8 Drawing Sheets

VENDING MACHINE COIN MECHANISM

TECHNICAL FIELD

This invention relates to a coin mechanism for a vending machine. More particularly this invention relates to a coin mechanism for a vending machine that includes a manually rotatable handle which in the mechanism's vending mode rotates a coil that dispenses vended product therefrom. Specifically, this invention relates to a coin mechanism for a vending machine that has a cylindrical coin receiver partially extending from the front end of the mechanism housing. Operation of the mechanism requires that the receiver be pushed completely into the housing with the proper purchase coins contained therein and rotated to dispense product from the coil attached thereto, the presence of the coins serving to unblock the mechanism during rotation thereof.

BACKGROUND OF THE INVENTION

Over the years, coin-operated vending machines have become increasingly popular for a variety of reasons, including the fact that they eliminate any need for human intervention in transacting sales of vended product. As a consequence, product can be sold at desired locations at any time of the day or night, without the assistance of sales personnel. Such machines are, therefore, of considerable convenience to both the purchaser and seller alike.

One popular version of such machines involves the use of parallel rows of horizontal coils disposed inwardly from the front of the machines, the coils being rotatable upon the insertion of a predetermined number of coins. Packages of the product being vended are held between adjacent loops of the coils and transported to a dispensing point as the coils are rotated.

In some types of machines, as in co-pending application, Ser. No. 492,824, the coils are directly connected to manually operated dispensing mechanisms, rather than to electrically driven linkages operated from a control panel. Manual operation is of considerable advantage since component failure within such a machine normally disables only one product-dispensing coil, rather than making the entire machine inoperable.

In addition, such manually driven machines contain far fewer components, and are much easier to repair than their motor-driven, electronically-controlled automatic counterparts. As a consequence of this simplicity, manually operated vending machines are much less expensive to manufacture than those of the automatic type. Because of their significantly lower cost, the manual machines can be located in lower volume sales locations while still providing an attractive return on the investment required for their purchase.

The larger, more expensive machines do, however, provide one very desirable characteristic in that they are capable of providing more sophisticated monitoring of the coins used to operate them. In this regard, the advantage inherent in all coin operated vending machines, i.e., they eliminate any need for human intervention in transacting sales, makes them relatively vulnerable to fraud by trick, or to the use of false tokens since sales personnel are not present to observe the vending transactions.

While the multiple testing of coins tendered to the operating mechanisms of the more elaborate vending machines has heretofore provided them with perhaps their most notable advantage, unfortunately such methods of testing typically require complex electrically operated components, and are thus incompatible with the objective of providing less expensive vending machines. However, the relative vulnerability of the manual machines to fraud has heretofore somewhat reduced their attractiveness to vendors, and it may be assumed that at least to a certain extent this has reduced the sales of such machines.

BRIEF DESCRIPTION OF THE INVENTION

In view of the preceding, therefore, it is a first aspect of this invention to provide an improved coin mechanism for manually operated vending machines.

A second aspect of this invention is to provide a coin mechanism for a manual vending machine that provides enhanced security with respect to attempts to operate the mechanism by fraudulent means.

Another aspect of this invention is to provide a manually operated coin mechanism in which access to the blocking components of the mechanism through the coin slots thereof is prevented.

A further aspect of this invention is to provide a manually operated coin mechanism in which the coin receiver must be completely inserted into the mechanism, and the coin slots contained therein thereby made inaccessible to a purchaser before there can be any communication between the coin slots and the blocking components during the process of obtaining vended product.

An additional aspect of the invention is to provide double blocking means in a manually operated coin mechanism to make it more difficult to defeat the mechanism in the absence of insertion of the proper coins.

Yet another aspect of this invention is to provide a manually operated coin mechanism that can be worked by the rotation of a coin receiver, and which cannot be operated in an improper direction.

A still further aspect of this invention is to provide a coin operating mechanism that can be easily adjusted to make it operable with different numbers of coins, and with coins of different dimensions.

The foregoing and other aspects of this invention are provided by a vending machine coin mechanism comprising a rotatable coin receiver cylinder containing slots for receiving purchase coins. The receiver cylinder is adapted to be positioned in a cylindrical passageway located in the housing of the mechanism, the housing containing means for preventing the rotation of the cylinder until the proper purchase coins have been inserted into the slots. Once the purchase coins have been placed in the slots, and the cylinder fully inserted into the housing, it can be rotated, the blocking means being unblocked by the coins during the rotation of the cylinder. Such rotation permits the operation of product release means and causes the coins to be released from the mechanism into a secure area.

The foregoing and still additional aspects of the invention are provided by a vending machine coin mechanism comprising a rotatable coin receiver cylinder that includes slots for receiving purchase coins, a cylinder rotation handle at the front end of the cylinder, and means for engaging blocking pawls to prevent the cylinder's rotation. The mechanism also includes a housing containing a cylindrical passageway from which the cylinder partially extends at the front end thereof, the cylinder being adapted to be moved along its longitudinal axis substantially completely within the passageway and then rotated therein. The housing further contains blocking pawls designed to engage the pawl engaging means and to prevent the rotation of the cylinder. Connecting means are also provided for connecting a product transport coil to the rear end of the cylinder, opposite the handle end thereof. Spring means urge the cylinder out of the passageway, away from the front end of the housing, and means are provided for blocking the rotation of the cylinder until it is substantially completely located within the passageway. When sufficient force is applied to the handle, longitudinal to the cylinder, the urging of the spring means can be overcome and the cylinder substantially completely inserted within the passageway. When the cylinder contains the proper coins and has thus been inserted, the cylinder can be rotated in a mechanism-operating direction and the pawls unblocked, thereby permitting the transport coil to be revolved, resulting in the release of product from the coil to a purchaser and permitting the coins to fall from the housing into a secure area.

The foregoing and further aspects of the invention are provided by a plug member suitable for insertion into a coin slot described in the preceding paragraphs in order to effect a change in the kind of coin required to operate the mechanism. The lower edge of the plug member has a lug extending from each end thereof adapted to fit into an undercut notch at the ends of the bottom of the coin slots. The upper edge of the plug member is shaped to receive a coin of the desired denomination, and the member is provided with a vertical notch adjacent each lug which allows temporary bending of the lug to facilitate insertion of the member into a coin slot.

The foregoing and yet additional aspects of the invention are provided by a vending machine that includes a coin mechanism according to any of the preceding paragraphs.

BRIEF DESCRIPTION OF THE DRAWINGS

The invention will be better understood when reference is had to the following drawings in which like numbers refer to like parts and in which.

DETAILED DESCRIPTION OF THE INVENTION

Figure 1:
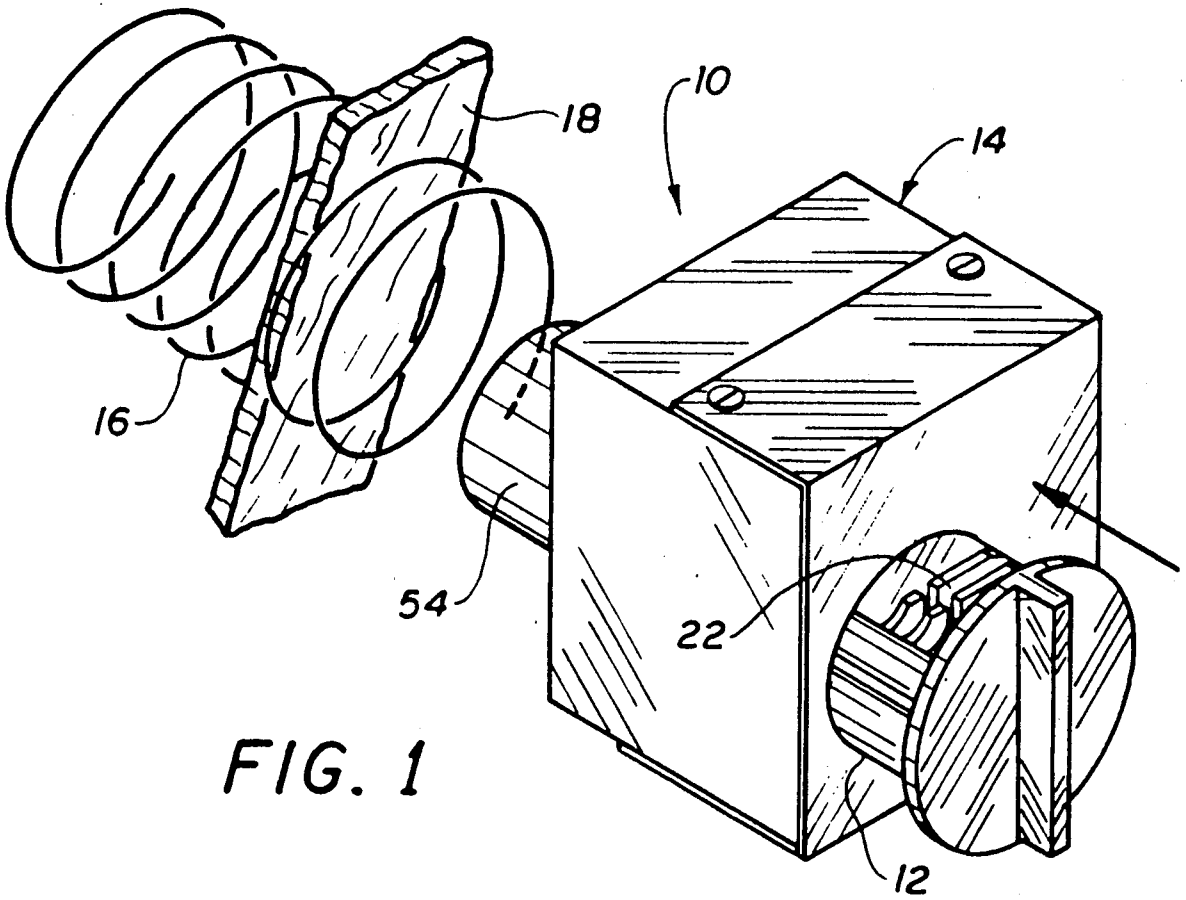
FIG. 1 is an isometric view of the coin mechanism of the invention prior to the insertion of coins therein.

FIG. 1 is an isometric view of the coin mechanism of the invention, generally 10, prior to the insertion of coins therein. As shown, the coin mechanism comprises a housing 14 from which a coin receiver cylinder 12 partially extends. The coin receiver cylinder 12 is designed for insertion along its longitudinal axis into the housing 14 after the proper coins have been inserted into the coin slots 22. A product transport coil 16 with a package of vended product 18 resting therein is shown attached to a coupler member 54 which is connected to the coin receiver cylinder 12, as will hereinafter be described. To operate the coin mechanism, the proper coins are inserted into the coin slots 22, after which the coin receiver cylinder 12 is pushed into the housing 14 and rotated to release product.

Figure 1A:
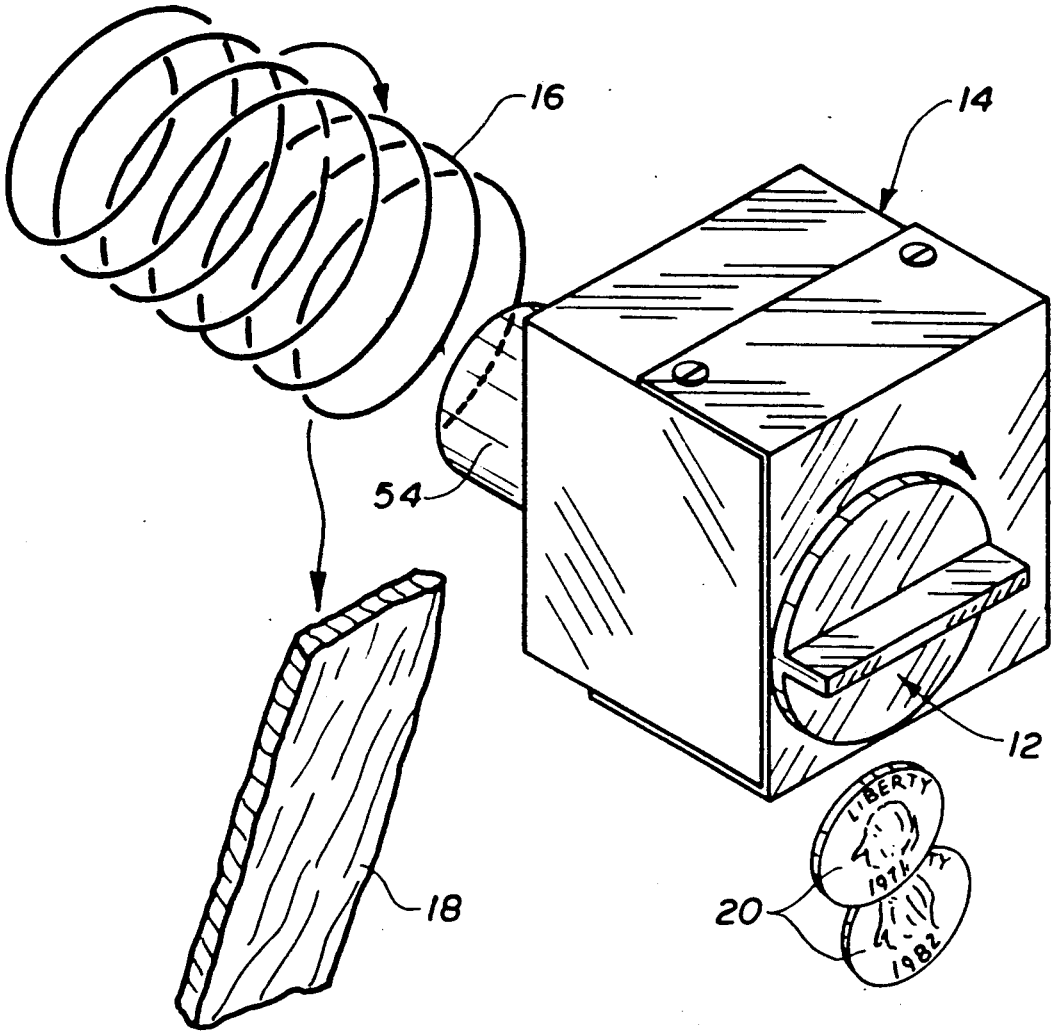
FIG. 1A is an isometric view of the coin mechanism of the invention following the insertion of coins and operation of the mechanism.

FIG. 1A is an isometric view of the coin mechanism of the invention following the insertion of the coins showing operation of the mechanism. After the coin receiver cylinder 12 has been inserted into the housing 14 with the proper coins, the receiver can be turned clockwise as shown by the associated arrow. Turning of the coin receiver, causes rotation of the coupler member 54 to which the product transport coil 16 is attached. Rotation of the coil in the direction of the associated arrow causes advancement of the vended product 18 to a point on the coil where the product at 18 is free to fall therefrom into a chute, not shown, which is accessible to the purchaser. At the same time, the purchase coins 20 fall from the housing 14 to a secure location within the vending machine.

One of the notable advantages of the coin mechanism described is that the blocking pawls within the housing which prevent rotation of the coin receiver in the absence of the correct number of coins being located therein, are inaccessible prior to insertion of the receiver, and are therefore protected from tampering. When the coin receiver 12 has been inserted into the housing 14, the pawls are likewise inaccessible, again protecting the pawls from tampering. It is only when the coin receiver cylinder 12 has been completely inserted inside the housing 14 that there can be any communication of the coin slots with the blocking pawls, and in that condition, the only access to the pawls is by the coins in the slots; consequently, only they are able to force the pawls into a non-blocking position.

Figure 2A:
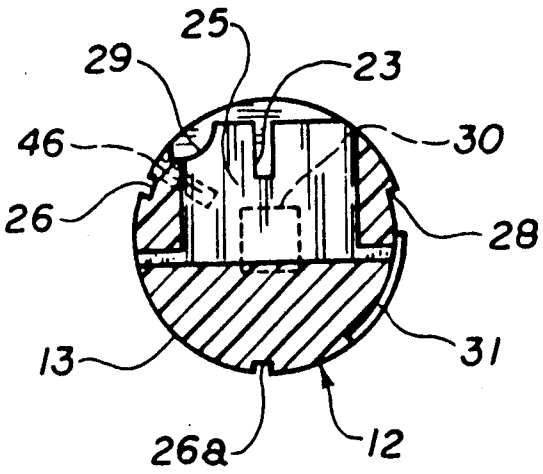
FIG. 2A is a cross-sectional view of a coin receiver cylinder of the invention along line 2A—2A of FIG. 2.
Figure 2:
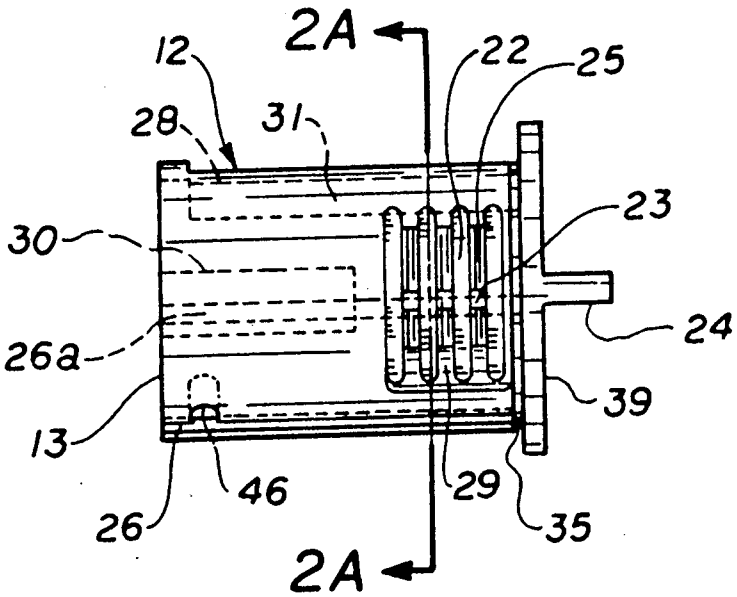
FIG. 2 is a top plan view of a coin receiver cylinder of the invention.

FIG. 2 is a top plan view of a coin receiver cylinder of the invention, generally 12. The Figure includes an operating handle 24 attached to a security flange 39. A guide tab groove 35 is located between the security flange 39 and the body of the coin receiver 13. The guide tab groove 35 is adapted to receive guide tabs 27, better seen in FIG. 5, after the coin receiver has been fully inserted into the coin mechanism housing. Receiver guide slots 26, 26*a*, and a portion of slot 31 are adapted to form a track for guide tabs 27 as the coin receiver 12 is inserted into the housing of the coin mechanism.

Shown in the Figure are coin slot partitions 25, which include a coin-lifting notch 23, whose purpose is described in more detail in connection with FIG. 2A. Also illustrated in FIG. 2 is a guide block receiver 30 whose function is to receive and guide the guide block 58 of the coupler member 54, shown in FIG. 4. Further seen in the Figure are shoulder stops 28 and 29 which constitute the dual, independent blocking means of the mechanism which engage the blocking pawls when the correct coins have not been inserted into coin receiving slots 22. An access port 46 is located in the coin receiver which enables travel of the receiver into the housing 14 to be controlled by travel limit pin 68, shown in FIG. 5.

A notable advantage of the coin mechanism of the invention resides in its relatively small height and width, which allows multiple mechanisms to be installed side-by-side in more limited space in a vending machine than would otherwise be possible. Within such considerations, the dimensions of the coin receiver cylinder 12 can be varied relatively broadly; however, typically the receiver will be about 1½ inches in diameter and about 1¾ inches to 2 inches long. In such case, the guide blocl receiver will be about 1 inch deep and approximately ⅜×⅜ inch square.

FIG. 2A is a cross-sectional view of a coin receiver cylinder of the invention along line 2A—2A of FIG. 2. Receiver guide slots 26 and 26*a* are shown located in the cylinder body 13, as is slot 31 with its associated shoulder pawl stop 28 located on one end thereof. Coin slot partition 25 is also illustrated, showing shoulder pawl stop 29 and coin-lifting notch 23 located therein. Also shown is an end view of guide block receiver 30, the dimensions of which have previously been described. The guide slots not only facilitate back and forth movement of the coin receiver 12 within housing 14, but serve to prevent deliberate misalignment or "cocking" of the cylinder in the housing in efforts to fraudulently manipulate the blocking pawls to unblock the coin mechanism and thereby obtain product without payment therefore.

The coin slots themselves are about 1 inch wide and about ⅞ inch deep, each having a width of about 1/16 inch.

Figure 3:
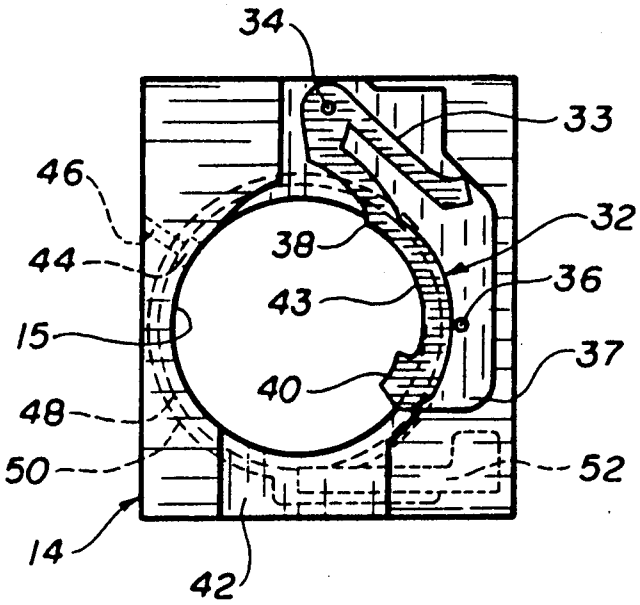
FIG. 3 is a front view of a housing of the coin mechanism of the invention.

FIG. 3 is a front view of a housing of a coin mechanism of the invention, generally 14. Shown is a receiver passageway 15, adapted to receive the body 13 of coin receiver 12. The passageway is provided with a guide pin slot 44 which receives guide pin 74, seen in FIG. 5B, and which controls the extent to which the coin receiver 12 can be withdrawn from the front of housing 14. Access port 46 communicates with guide pin slot 44 allowing the longitudinal travel of the coin receiver 12 to be further limited by insertion of travel limit pin 68. At the far, or rear end of receiver passageway 15 are located two annular grooves, 48 and 50 respectively, concentric to the passageway. Groove 50 is designed to receive a ratchet wheel 56, better seen in FIG. 4A, while groove 48 provides a race for the travel of guide pin 74 after the coin receiver 12 has been fully inserted into housing 14 and rotated. Ratchet pawl 52 prevents the ratchet wheel 56 from being rotated in a direction opposite to the proper operating direction of the coin receiver 12.

A blocking pawl, generally 32, is mounted on pawl mounting pin 34, consisting of a bifurcated structure comprising a pawl spring arm 33, which serves to force blocking pawl tip 40 at the end of pawl arm 43 into the receiver passageway 15. A pawl cam surface 38 is located between the pawl mounting pin 34 and the pawl tip 40. A pawl deactivation pin 36 is also shown whose purpose is described in connection with FIG. 3C.

Like the coin receiver 12, the dimensions of the housing 14 can be varied rather widely. In the case of a coin receiver having dimensions as described in the preceding, the housing will commonly be approximately 2¼ inches wide by 2½ inches high. Such a housing will be about 2 inches deep. Importantly, the housing 14 is provided with a housing recess 37, and in the case of a housing having the dimensions outlined, the recess will be about ¾ inches deep.

Figure 3A:
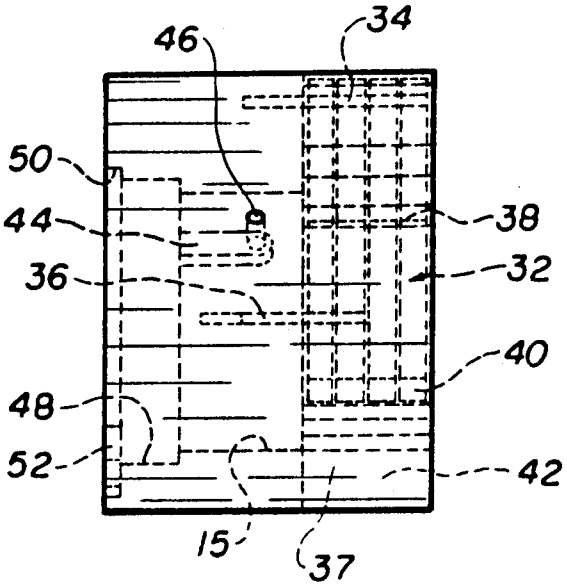
FIG. 3A is a side elevation of the housing of FIG. 3.

FIG. 3A is a side elevation of the housing of FIG. 3 through which receiver passageway 15 extends, communicating with the annular grooves concentric therewith, 48 and 50 respectively, the function of which has been described in the preceding. Also shown is ratchet pawl 52 whose purpose has likewise been indicated. Pawls 32, mounted on pin 34, and which include pawl cam surface 38 and pawl tip 40, are shown in a position in which two of the pawls are deactivated by deactivation pin 36, all of the pawls being located in housing recess 37. Coin chute 42 through which the coins are discharged from the coin mechanism 10 into a secure area is also illustrated, and the positioning of access port 46 can be clearly seen. As will be appreciated, the travel of the coin receiver cylinder 12 is determined by the distance which guide pin 74 is able to travel along slot 44 until it reaches the end of the slot, but it can also be limited by insertion of travel limit pin 68 in access port 46. By suitably curtailing the travel of the coin receiver 12, fewer of the coin slots 22 are exposed, providing one method for determining the coins that can be inserted in the receiver, and therefore of controlling the price of the goods vended.

Figure 3C:
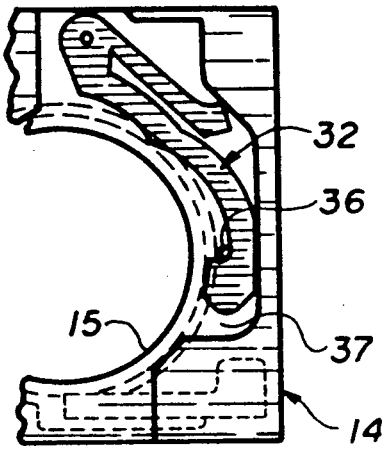
FIG. 3C is a partial front view of a housing of the coin mechanism of the invention showing blocking pawls of the mechanism in an immobilized position.
Figure 3B:
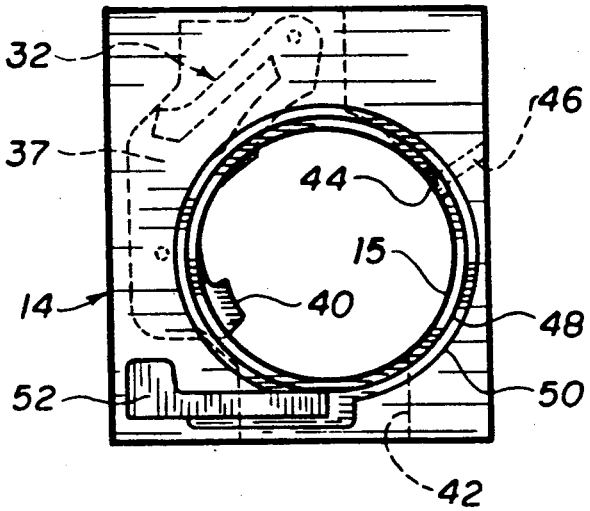
FIG. 3B is a rear elevation of the housing of FIG. 3.

FIG. 3B is a rear elevation of the housing of FIG. 3. The Figure shows the housing 14 through which the receiver passageway 15 extends, communicating with the annular grooves 48 and 50, concentric to passageway 15. The housing has a recess 37 therein, in which the pawls 32 are disposed, the pawl tips 40 of which in their blocking mode are urged inwardly toward the center of the passageway 15. The coin receiver cylinder travel-limiting guide pin slot 44 is shown, as is access port 46 which as indicated, can be used to further limit the travel of the coin receiver 12. Also shown is ratchet pawl 52 partially blocking groove 50 to prevent improper rotation of the coin receiver as previously explained.

FIG. 3C is a partial front view of a housing of the coin mechanism of the invention showing blocking pawls of the mechanism in an immobilized position.

The Figure shows a housing 14 in which some of the pawls 32 have been forced outwardly, away from passageway 15, so as to be incapable of engaging blocking shoulder stops 28 and 29. The pawls are held in an immobilized position within housing recess 37 by means of pawl deactivation pin 36, also seen in FIG. 3A.

The dimensions of the pawls will depend upon the other dimensions of the coin receiver 12 and the housing 14; however, in the case of the dimensions already outlined, pawl arm 43 will be about 2 inches long, while the pawl spring arm 33 will be about 1 inch long. Typically, approximately ⅛ inch will be provided between the bifurcated arms to accommodate the distance that the arms can be moved toward each other to provide the necessary elasticity of one relative to the other. The thickness of pawls in such case will be about ⅜ inch.

Figure 4:
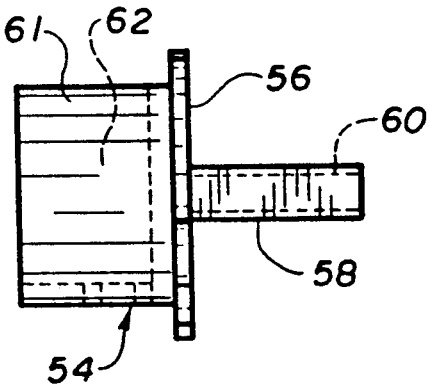
FIG. 4 is a side elevation of a coupler of the invention.

FIG. 4 is a side elevation of a coupler of the invention, generally 54. The coupler member comprises a ratchet wheel 56 attached on one side to a transport coil connector cylinder 61, and on the other to a guide block 58 which contains a spring receiver chamber 60. The spring receiver chamber is designed to accommodate spring 66, better seen in FIG. 5, which serves the purpose of urging the coin receiver cylinder 12 away from the housing 14 so that coins can be inserted therein. The transport coil connector cylinder 61 has a transport coil connector slot 62 located therein to permit attachment of the product transport coil by means well known in the art. The ratchet wheel 56 by its interaction with ratchet pawl 52 serves to prevent improper rotation of the coin receiver 12. By preventing improper rotation, the ratchet wheel 56 prevents damage to the mechanism, and also prevents continued manipulation in an attempt to defeat the mechanism.

Figure 4A:
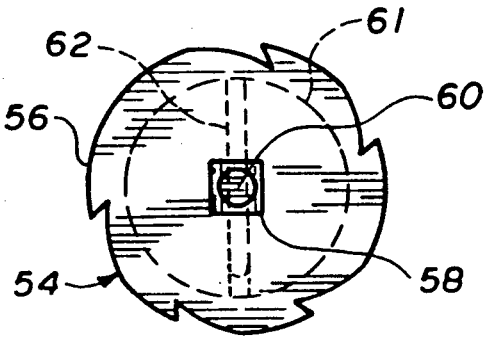
FIG. 4A is a front elevation of the coupler of FIG. 4.

FIG. 4A is a front elevation of the coupler member of FIG. 4, generally 54. The Figure shows the ratchet wheel 56 and the transport coil connector cylinder 61. Also shown is the connector slot 62 of the connector cylinder 61, provided for the purpose of attachment of the product transport coil 16. Guide block 58 with its spring receiver 60 can also be seen.

The dimensions of the coupler member 54 may be broadly varied, but in conjunction with the components having dimensions previously described the rachet wheel will be about 1¾ inches in diameter, while the guide block will be about 1 inch long, about ⅜ inches high and ⅜ inches wide; typically, the spring receiver will have a diameter of about ¼ inch.

Figure 5A:
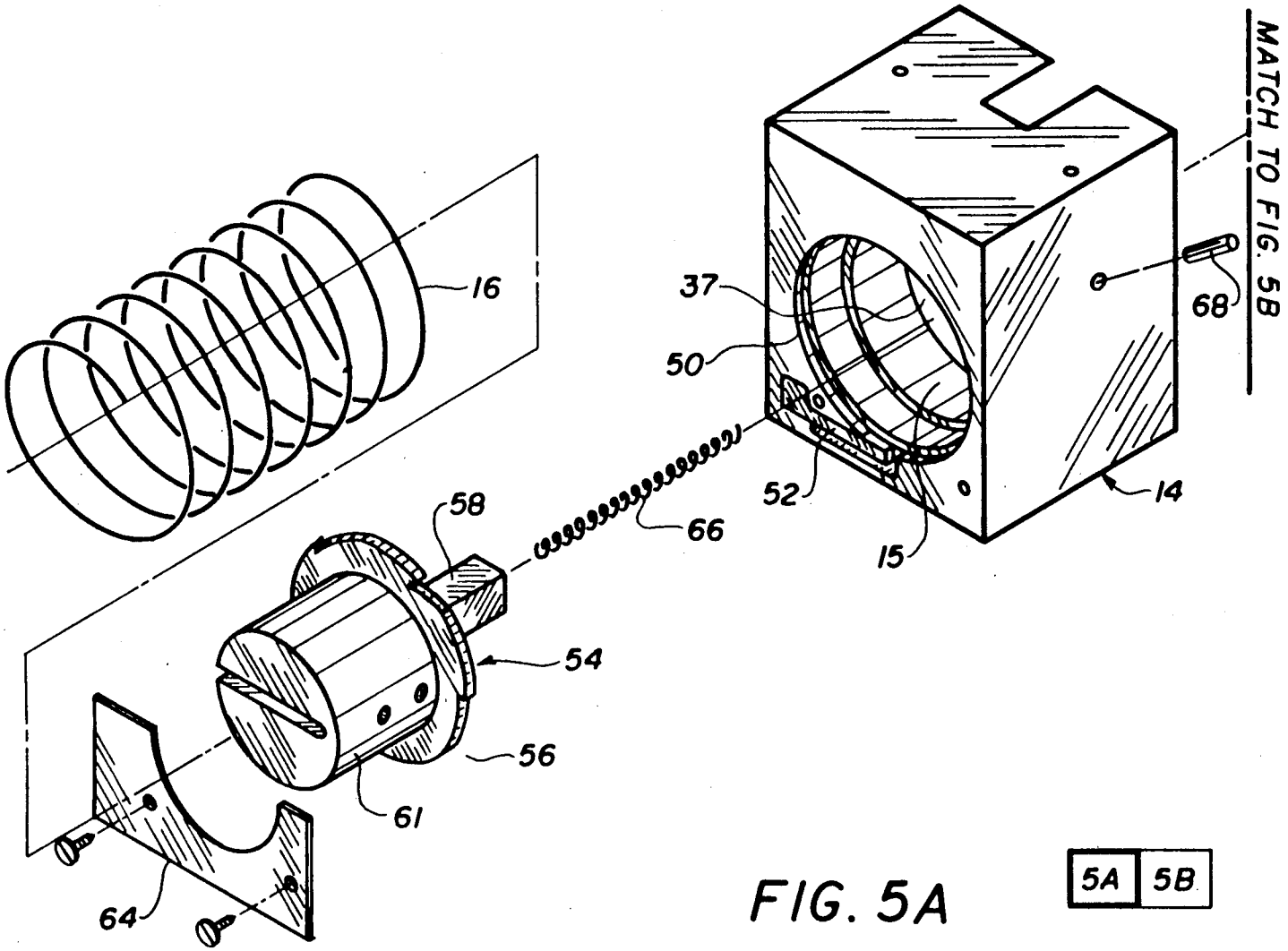
FIGS. 5A and 5B are exploded views of the coin mechanism of the invention.
Figure 5B:
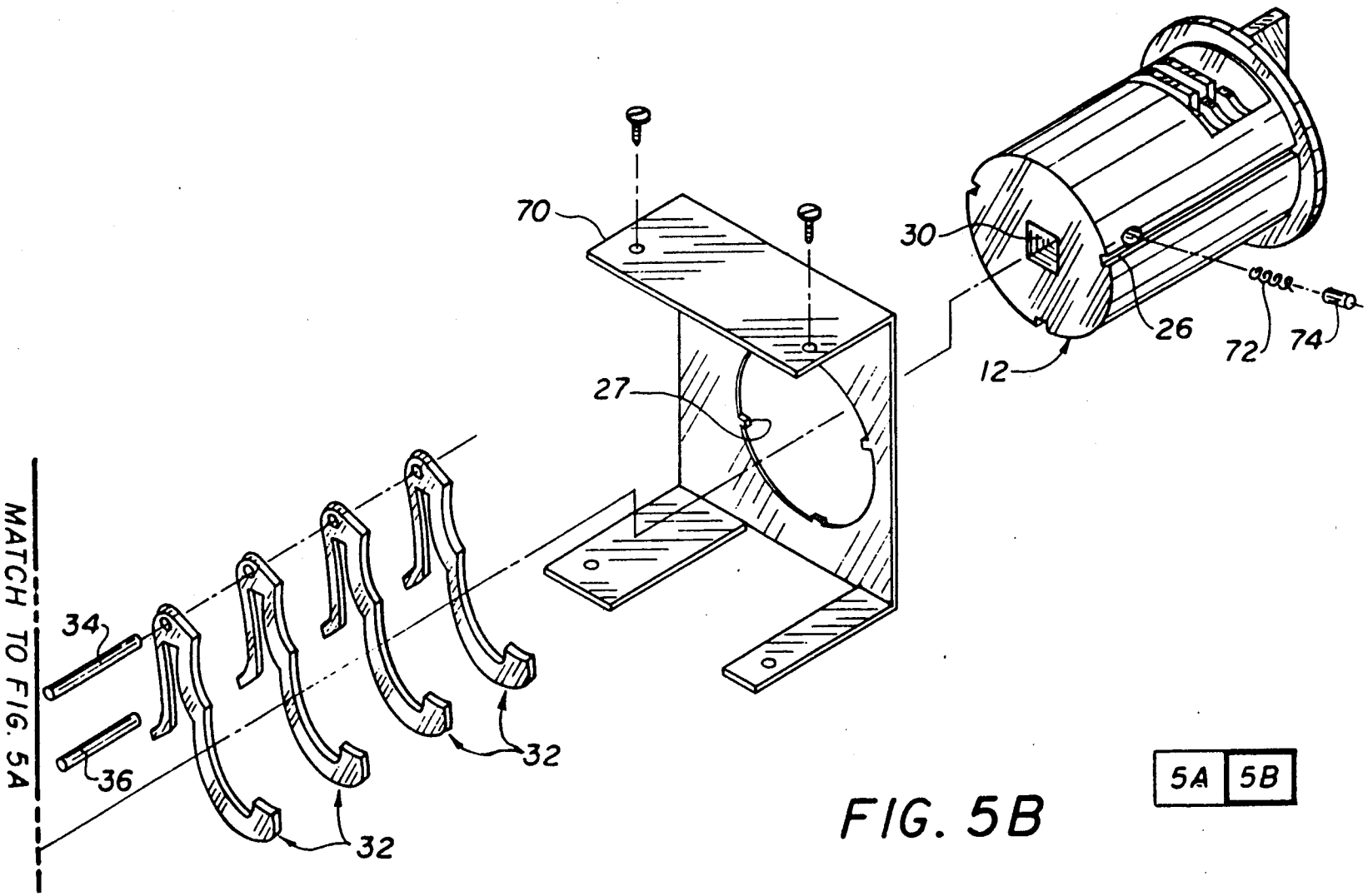

FIGS. 5A and 5B show an exploded view of the coin mechanism of the invention. Assembly involves insertion of coin receiver cylinder 12 through guide plate 70 into passageway 15 of housing 14. Guide tabs 27 serve to locate and stabilize the coin receiver cylinder 12, being received, for example in receiver guide slot 26. Pawls 32 are mounted within housing recess 37 on pawl mounting pin 34, pawl deactivation pin 36 being provided optionally to deactivate one or more of the pawls, as previously described. Guide pin 74 urged outwardly by spring 72 both guides and limits the longitudinal movement of the coin receiver cylinder 12 as it moves in and out of the passageway 15. The movement of the coin receiver cylinder 12 is further limited by the optional insertion of travel limit pin 68. A coupler member 54 serves to connect the product transport coil 16 to the coin receiver cylinder 12. Such connection is effected by the insertion of guide block 58 into guide block receiver 30, and a spring 66 is provided between the two elements to cause the coin receiver cylinder 12 to be urged outwardly from the front of housing 14. A ratchet wheel 56 is received into annular groove 50, and with its cooperation with ratchet pawl 52 prevents rotation of the coin receiver cylinder 12 in a non-operating direction. Connection between the product transport coil 16 and the coupler member 54 is made possible by connection of the coil to connector cylinder 61. Coupler member 54 is retained within housing 14 against the urging of spring 66 by means of a retainer clip 64 fastened to housing 14.

Although metal can be used, the principal parts of the coin mechanism 10, including the coin receiver cylinder 12, housing 14, coupler member 54 and pawls 32, are preferably made from plastic since this permits them to be inexpensively fabricated, for example, by injection molding or other techniques well known in the trade. Any of a variety of plastics can be employed for the purpose, including particularly those of the thermoplastic type such as, for instance, nylon, ABS, acrylics, polycarbonates, acetals, polystyrene, and others.

Figure 6:
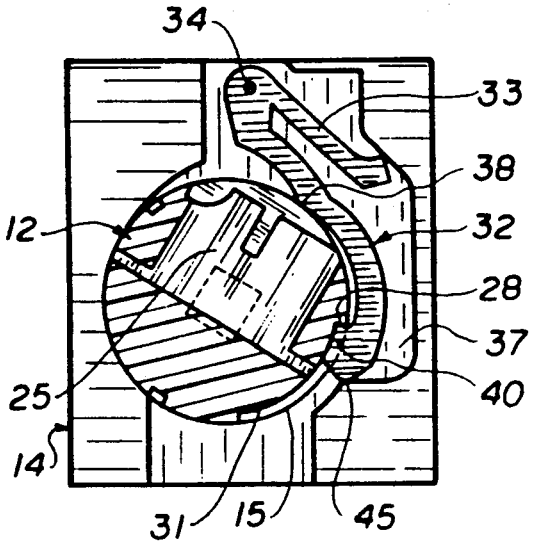
FIG. 6 is a semi-schematic drawing of the coin mechanism of the invention showing an interior view of the mechanism in a first blocking position.

FIG. 6 is a semi-schematic drawing of the coin mechanism of the invention showing an interior view of the mechanism in a first blocking position. As shown, the coin receiver 12 is inserted in passageway 15. In the Figure, no coin has been inserted in the coin slots of the coin receiver cylinder; however, an attempt has been made to rotate the cylinder in its clockwise, operational direction. As a consequence, the pawl tip 40 of pawl 32 has engaged the blocking shoulder stop 28 forming one end of slot 31, preventing further rotation of the coin receiver 12. The pawl 32, mounted on pawl mounting pin 34 is forced into its blocking position by the pawl spring arm 33.

As can be seen, in its blocking position pawl tip 40 is forced against the edge 45 of housing recess 37 by the abortive attempt to rotate the coin receiver 12, resulting in pawl tip 40 being placed in compression during the blocking process. The pawl tip is well adapted to withstand compression stressing; consequently it is not only able to withstand attempts to force the cylinder and to defeat the mechanism, but because the pawls are only subjected to compression stressing they are characterized by long life.

Figure 6A:
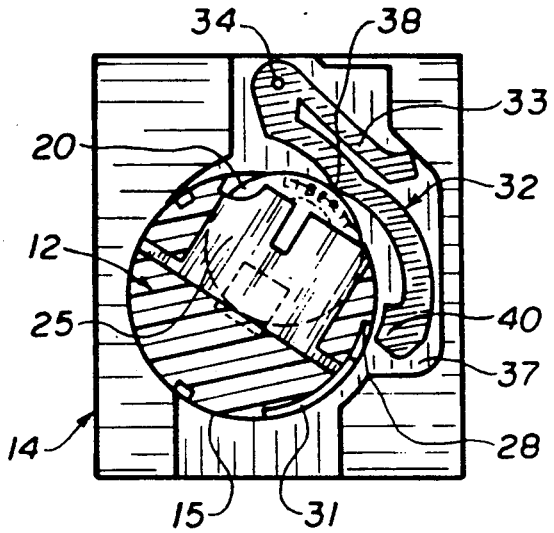
FIG. 6A is a semi-schematic drawing of the coin mechanism of the invention showing unblocking of the blocked mechanism illustrated in FIG. 6.

FIG. 6A is a semi-schematic drawing of the coin mechanism of the invention showing unblocking of the blocked mechanism illustrated in FIG. 6. In the Figure, a coin 20 has been inserted in a coin slot of the mechanism, adjacent the pawl 32. During rotation of the coin receiver cylinder 12 in passageway 15, the camming surface 38 of the pawl is forced away from the passageway 15, against the force of the pawl spring arm 33, displacing pawl tip 40 away from shoulder stop 28, allowing rotation of the receiver cylinder to continue.

Figure 7:
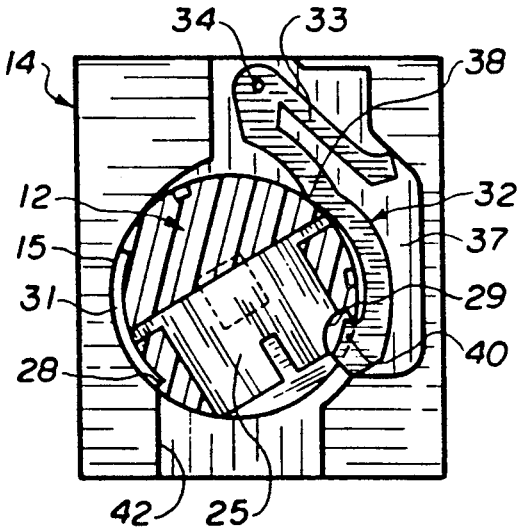
FIG. 7 is a semi-schematic drawing of the coin mechanism of the invention showing an interior view of the mechanism in a second blocking position.

FIG. 7 is a semi-schematic drawing of the coin mechanism of the invention showing an interior view of the mechanism in a second blocking position.

The Figure shows a situation in which the coin mechanism 10 has been forced, or has malfunctioned, allowing the coin receiver 12 to proceed beyond shoulder stop 28. In such case, urged by pawl spring arm 33, the pawl tip 40 of pawl 32 has engaged shoulder stop 29, preventing further rotation of the coin receiver cylinder 12 in passage 15.

Figure 7A:
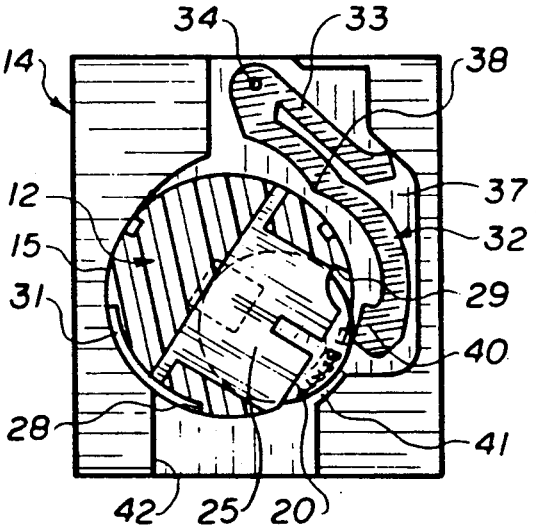
FIG. 7A is a semi-schematic drawing of the coin mechanism of the invention showing unblocking of the blocked mechanism illustrated in FIG. 7.

FIG. 7A is a semi-schematic drawing of the coin mechanism of the invention showing the unblocking of the blocked mechanism illustrated in FIG. 7. The Figure is really a continuation of the condition shown in FIG. 6A in which the coin receiver cylinder 12 has been rotated in passageway 15 beyond shoulder stop 28. As a consequence of the presence of coin 20 in the coin receiver cylinder 12, the pawl tip 40 of pawl 32 has been forced against the urging of pawl spring arm 33 outwardly into housing recess 37, preventing engagement of the pawl tip with shoulder stop 29. This allows the coin receiver cylinder 12 to continue its rotation to the point at which the coin 20 falls through opening 42 into a secure area of the coin mechanism.

The device of the invention described defeats attempts to steal merchandise from vending machines equipped with the coin mechanism in a number of ways in addition to those described in the preceding, as follows.

For example, the coin mechanism of the invention provides a housing recess 37 and clearance space 41 which allows a coin protruding from a coin slot to progress to coin chute 42 without hinderance; however, if an attempt is made to wedge the coin into the coin slot in order to prevent its falling therefrom so that the coin receiver can be continuously rotated with the same coin, the lack of any clearance between the coin receiver cylinder 12 and the housing 14 at the left side of the mechanism, as seen in the Figure, prevents the coin from preceding beyond the coin chute 42, defeating the attempt.

Furthermore, if an attempt is made to use a coin of a smaller dimension than the correct coin, for example a penny rather than a quarter, through the artifice of inserting a filler in the bottom of the coin slot to raise the height of the smaller coin to equal that of the larger size coin, then as the coin receiver cylinder is rotated, the coin will roll to the side of the coin slot opposite shoulder stop 29, resulting in engagement of pawl tip 40 with shoulder stop 29, again preventing defeat in the machine.

From the foregoing, it will be seen that the pawls of the mechanism, together with this dual shoulder stops provide double protection for the mechanism, a significant advantage in the event one of the blocking shoulder stops fails for some reason. The dual shoulders also prevent the coin receiver from being accelerated to a velocity at which engagement of the pawl tip 40 with a single shoulder stop could fail to occur. Location of a first shoulder stop proximate to the point at which rotation of the coin receiver has just begun, also prevents appreciable rotation of the receiver in the absence of inserted purchase coins.

Figure 8:
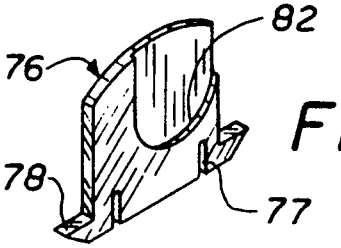
FIG. 8 is an isometric view of a coin alteration plug of the invention.

FIG. 8 is an isometric view of a coin alteration plug of the invention.

A method by which the number of coins required to operate the coin mechanism of the invention can be changed has already been described, i.e., by inactivation of one or more of the pawls with a pawl deactivation pin 36, with or without a reduction in permissible travel of the coin receiver by appropriate location of travel limit pin 68. From time-to-time, however, it also becomes desirable to change the value, and therefore the dimensions of the coins required to operate the mechanism. In such instances, the use of a coin alteration plug 76 is desirable. Such a plug comprises an insert having an opening 82 dimensioned to receive a different sized coin. The insert is provided with locking tabs 78 which can be temporarily bent as a consequence of the provision of tab bending notches 77 and inserted in tab notches 80, better seen in FIG. 8A.

Figure 8A:
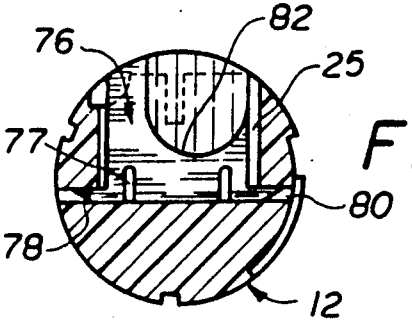
FIG. 8A is a front elevation of a coin alteration plug of the invention inserted in a coin slot in a coin receiver cylinder of the invention.

FIG. 8A is a front elevation of a coin alteration plug of the invention, inserted in a coin slot of a coin receiver cylinder 12. As shown, a coin alteration plug 76 has been inserted in a coin slot, each end of the bottom of which has an undercut notch 80. Insertion is accomplished by compressing the locking tabs 78 in the direction of the tab bending notches 77, allowing the plug to be inserted adjacent to the coin slot partition 25. Once the bottom of the plug reaches the bottom of the coin slot, the elasticity of the locking tabs propels them outwardly into the tab notches 80, locking the plug securely in position.

While in accordance with the patent statutes, a preferred embodiment and best mode has been presented, the scope of the invention is not limited thereto, but rather is measured by the scope of the attached claims.

What is claimed is:

1. A coin mechanism for a vending machine comprising: a rotatable coin receiver cylinder, movable along its longitudinal axis and containing slots for receiving predetermined purchase coins;

a housing having a cylindrical passageway therein adapted to receive said cylinder and allow it to be moved from a first position where said slots are located outside said housing to a second position where said cylinder is substantially fully inserted into said housing; and blocking means within said housing for preventing the rotation of said cylinder until the proper purchase coins have been placed in said slots, wherein only after said cylinder has been substantially fully inserted into said housing with the predetermined coins therein can said cylinder be rotated, said blocking means being unblocked by said predetermined coins during rotation of said cylinder, and the rotation of said cylinder causing the operation of product release means, releasing product from said machine, and causing said predetermined coins to be released from said mechanism into a secure area.

2. A vending machine that includes a coin mechanism according to claim 1.

3. A vending coin mechanism comprising:

a rotatable coin cylinder including slots therein for receiving purchase coins, means for rotating said cylinder at the front end of said cylinder, and means for engaging blocking pawls to prevent the cylinder's rotation;

a housing containing a cylindrical passageway from which the front end of said cylinder partially extends from the front end of the said housing, being adapted to be moved along its longitudinal axis substantially completely within said passageway and then rotated therein, and blocking pawls designed to engage said engaging means and to prevent the rotation of said cylinder;

connecting means for connecting a product transport coil to the rear end of said cylinder;

spring means for urging said cylinder out of said passageway, outwardly from the front end of said housing; and means for blocking the rotation of said cylinder until it is substantially completely located within said passageway, wherein when sufficient force is applied to said cylinder along its longitudinal axis, said urging can be overcome and said cylinder substantially completely inserted within said passageway, and further, when proper coins have also been inserted into said slots, said cylinder can be rotated in a mechanism-operating direction and said pawls unblocked, thereby permitting said transport coil to be rotated, releasing product from said coil to a purchaser and permitting said coins to fall from said housing into a secure area.

4. A mechanism according to claim 3 wherein said pawl-engaging means comprises two spaced apart shoulders located on said cylinder, each of which is separately adapted to engage said blocking pawls, preventing rotation of said cylinder.

5. A mechanism according to claim 4 in which one of said shoulders is formed by a longitudinal groove in said cylinder, and the other said shoulder is formed by a notch in partitions separating said coin slots.

6. A mechanism according to claim 5 in which said partitions include an opening therein for forcing coins out of said slots in order to retrieve them.

7. A mechanism according to claim 3 in which each of said slots comprises a vertical opening adapted to receive a coin therein, said openings having an undercut notch at the ends of the bottom thereof.

8. An insert for insertion into a coin slot according to claim 7 to effect an alteration in the kind of coins required to operate the mechanism comprising a plug member, the lower edge of which has a lug extending from each end thereof adapted to fit into said undercut notches, the upper edge of which member is shaped to receive a coin of the desired denomination, and said member being provided with a vertical notch adjacent each lug to allow temporary bending of the lugs during insertion thereof.

9. A mechanism according to claim 4 wherein each of said blocking pawls is fastened on a mounting pin within said housing and is provided with a camming surface between said pin and a portion of said pawl adapted to engage said shoulders.

10. A mechanism according to claim 9 wherein said pawl is bifurcated, one of the bifurcated portions having said camming surface and said engaging portion located thereon, and the other bifurcated portion serving to urge the engaging portion into a shoulder engaging position.

11. A mechanism according to claim 3 wherein said connecting means includes a ratchet wheel positioned in an annular groove concentric to said passageway located at the rear end of said housing, whose interaction with a pawl located within said groove, prevents movement of said mechanism opposite to said operating direction.

12. A mechanism according to claim 11 wherein said connecting means includes a male member slidably inserted into a counterpart female opening in the rear of said cylinder, and non-rotatable therein.

13. A mechanism according to claim 12 wherein said male member is hollow and said spring means is located therein.

14. A mechanism according to claim 3 which also includes a plate member at the front end of said housing having guide tabs extending from a cylindrical passageway therein which fit into longitudinal grooves located on the external surface of said cylinder, said grooves and said tabs cooperating to stabilize the movement of said cylinder in and out of the cylindrical passageway in said housing.

15. A mechanism according to claim 3 whereby said cylinder is provided with a pin extending radially from a hole in said cylinder, and retractable therein, said pin being urged by a spring to protrude from said hole into a slot in the surface of said cylindrical passageway extending longitudinally from a point intermediate the front and rear ends of said housing and communicating at the rear end with an annular ring in said housing concentric to said passageway, said pin and said slot interacting to limit the extent of protrusion of said cylinder outward from the front of said passageway, and serving as a guide for said cylinder in the process of its movement in and out of said passageway as the pin travels along said slot, and also serving as a race for said pin during the cylinder's rotation as the pin travels around said ring.

16. A mechanism according to claim 3 wherein the interior of said housing adjacent said passageway provides clearance for purchase price coins contained in said slots as said cylinder is rotated only to the point at which the coins are intended to fall from said housing.

17. A mechanism according to claim 3 which includes means for immobilizing selected pawls, thereby preventing their engagement with said engaging means.

* * * * *